US012245682B2

(12) United States Patent
Gormany

(10) Patent No.: US 12,245,682 B2
(45) Date of Patent: Mar. 11, 2025

(54) POWERED TOILET BOWL BRUSH

(71) Applicant: Freeman Gormany & Group Corporation, Lubbock, TX (US)

(72) Inventor: Freeman Gormany, Grand Prairie, TX (US)

(73) Assignee: Freeman Gormany & Group Corporation

( * ) Notice: Subject to any disclaimer, the term of this patent is extended or adjusted under 35 U.S.C. 154(b) by 285 days.

(21) Appl. No.: 17/742,582

(22) Filed: May 12, 2022

(65) Prior Publication Data

US 2022/0378186 A1 Dec. 1, 2022

Related U.S. Application Data

(60) Provisional application No. 63/205,663, filed on May 25, 2021.

(51) Int. Cl.
*A46B 13/02* (2006.01)
*A47K 11/10* (2006.01)

(52) U.S. Cl.
CPC ..... *A46B 13/02* (2013.01); *A47K 11/10* (2013.01)

(58) Field of Classification Search
CPC ... A46B 13/02; A46B 13/0008; A46B 13/001; A46B 2200/304; A46B 2200/3006;
(Continued)

(56) References Cited

U.S. PATENT DOCUMENTS 3,150,399 A * 9/1964 Mann ..... A47K 13/302 4/662
4,353,144 A * 10/1982 Mayberry ..... A47K 11/10 15/56

(Continued)

FOREIGN PATENT DOCUMENTS

WO WO-2019069313 A1 * 4/2019

OTHER PUBLICATIONS

ActiClean Toilet https://www.americanstandard-us.com/acticlean-toilet Accessed Jan. 12, 2022.

(Continued)

*Primary Examiner* — Eric J Rosen
*Assistant Examiner* — John C Merino
(74) *Attorney, Agent, or Firm* — Argus Intellectual Enterprise, LLC; Jordan Sworen; Daniel Enea

(57) ABSTRACT

A powered toilet bowl brush for automatically cleaning an interior of a toilet bowl. The toilet bowl brush includes a splash guard member having a brush assembly disposed on a first side and a housing on an opposing side thereof. The splash guard member is sized to rest atop a perimeter of a toilet bowl and prevent liquid from splashing out of the toilet bowl when in use. A shaft extends from the housing and through the splash guard member, wherein a distal end of the shaft is secured to the brush assembly. The shaft is operably connected to a motor that moves the brush assembly along a vertical axis. In some embodiments, the brush assembly is rotatably secured to the shaft and is capable of rotating 360 degrees about the vertical axis. In operation, the brush assembly is activated to automatically clean the interior of the toilet bowl.

17 Claims, 5 Drawing Sheets

(58) Field of Classification Search
CPC ..... A47K 11/10; A47K 13/302; A47K 13/10; E03D 9/002
See application file for complete search history.

(56) References Cited

U.S. PATENT DOCUMENTS

| | | | | |
|---|---|---|---|---|
| 8,011,051 | B1 * | 9/2011 | Ba-Akeel | A46B 5/0012 15/56 |
| 9,644,358 | B2 | 5/2017 | Quals et al. | |
| 11,486,125 | B2 * | 11/2022 | Joukov | E03D 9/002 |
| 2009/0044322 | A1 | 2/2009 | Nunez et al. | |
| 2018/0242722 | A1 * | 8/2018 | Patterson | A46B 7/04 |

OTHER PUBLICATIONS

NeverScrub Automatic Toilet Cleaning System https://www.southernpipe.com/2325799/PRODUCT/N/NeverScrub-1157 Accessed Jan. 12, 2022.

Tobias Roberts, Self-Cleaning Toilets: The Pros and Cons, web article, Jun. 13, 2021, Rise Writer https://www.buildwithrise.com/stories/self-cleaning-toilets Accessed Jan. 12, 2022.

* cited by examiner

POWERED TOILET BOWL BRUSH

CROSS REFERENCE TO RELATED APPLICATION

This application claims the benefit of U.S. provisional application No. 63/205,663 filed on May 25, 2021, the above identified patent application is herein incorporated by reference in its entirety.

BACKGROUND OF THE INVENTION

The present invention relates to a toilet bowl brush. More specifically, the present invention relates to toilet bowl brush that is motorized to provide hand-free cleaning of an interior of a toilet bowl.

Common toilet bowl brushes are hand-held and require a user to scrub away the grime and scum from the porcelain. This continuous movement can lead to fatigue and discourage people from cleaning their toilets as often as needed. Further, the manual movement of pushing and pulling the handle of the brush causes liquid from the toilet to splash out of the bowl, leading to additional mess on the floor and contamination to the user. Therefore, there exists a need for a toilet bowl brush that is mechanically operated for hands-free cleaning and includes a splash guard to prevent liquid from leaving the toilet bowl while the toilet bowl is being cleaned.

In light of the devices disclosed in the known art, it is submitted that the present invention substantially diverges in design elements and methods from the known art and consequently it is clear that there is a need in the art for an improvement for a powered toilet bowl brush. In this regard the instant invention substantially fulfills these needs.

SUMMARY OF THE INVENTION

In view of the foregoing disadvantages inherent in the known types of powered toilet bowl brushes now present in the known art, the present invention provides a powered toilet bowl brush for mechanically cleaning the interior of a toilet bowl.

It is an objective of the present invention to provide an embodiment of a powered toilet bowl brush comprising a splash guard member having a brush assembly disposed on a first side and a housing extending from a second side of the splash guard member, wherein the splash guard member is sized to rest atop a perimeter of a toilet bowl. A shaft extends from the housing and through the splash guard member, wherein a distal end of the shaft is secured to the brush assembly. The shaft is configured to mechanically move the brush assembly along a vertical axis.

It is another objective of the present invention to provide an embodiment of the powered toilet bowl brush wherein the brush assembly is rotatably secured to the shaft and configured to rotate 360 degrees about the vertical axis.

It is another objective of the present invention to provide an embodiment of the powered toilet bowl brush having a pair of clamping fasteners configured to secure the splash guard member to the toilet bowl.

It is another objective of the present invention to provide an embodiment of the powered toilet bowl brush wherein the brush assembly comprises a first layer and a second layer of scrubbers extending in a horizontal plane when secured to the shaft. The first layer and the second later of scrubbers are parallel to one another and each comprise a different diameter.

It is therefore an object of the present invention to provide a new and improved powered toilet bowl brush that has all of the advantages of the known art and none of the disadvantages.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings.

DETAILED DESCRIPTION OF THE INVENTION

Reference is made herein to the attached drawings. For the purposes of presenting a brief and clear description of the present invention, the preferred embodiment will be discussed as used for automatically cleaning the interior of a toilet bowl in a hands-free manner. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment", "first embodiment", "second embodiment", or "third embodiment" does not necessarily refer to the same embodiment.

Figure 1:
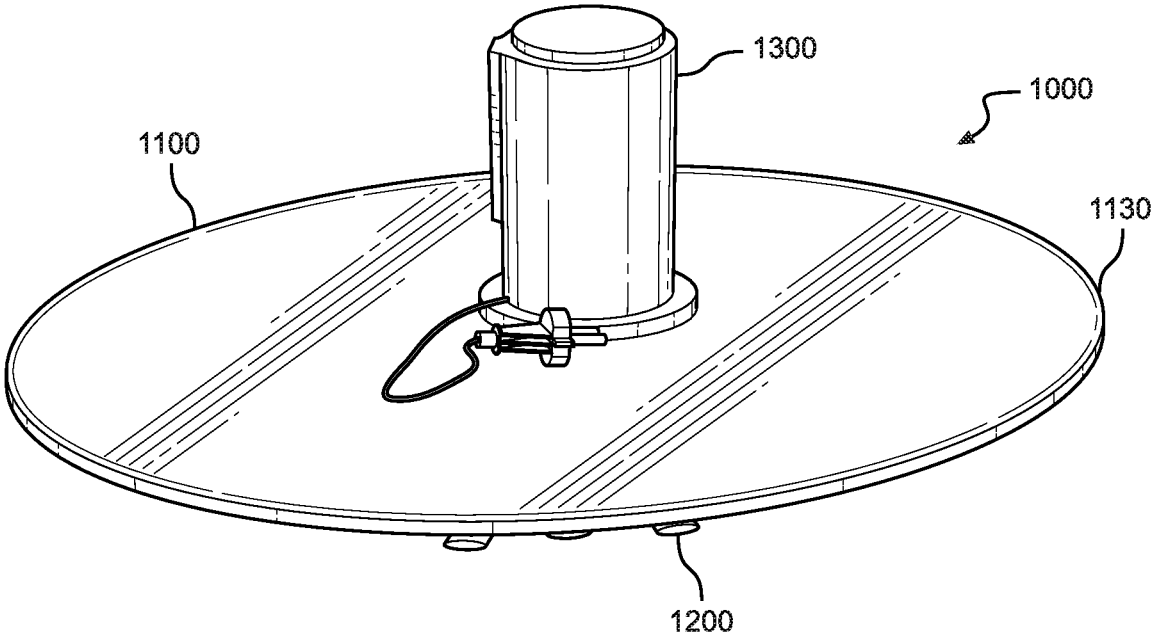
FIG. 1 shows a top perspective view of an embodiment of the powered toilet bowl brush.
Figure 2:
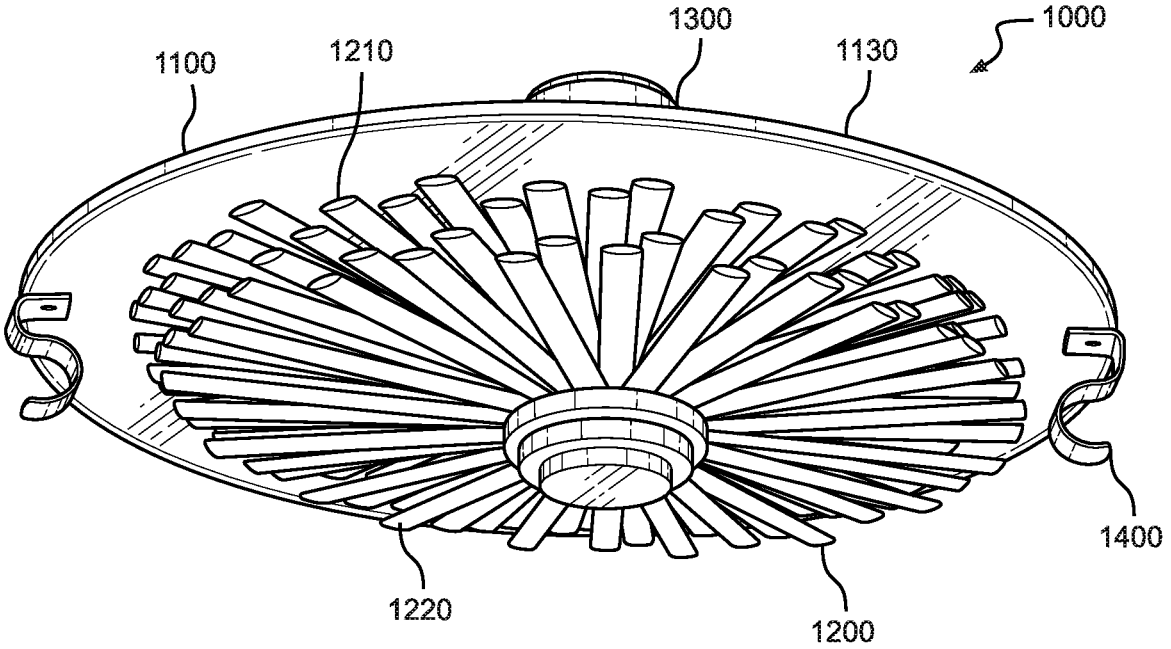
FIG. 2 shows a bottom perspective view of an embodiment of the powered toilet bowl brush.

Referring now to FIGS. 1 and 2, there is shown a top and a bottom perspective view of an embodiment of the powered toilet bowl brush, respectively. The powered toilet bowl brush 1000 comprises a splash guard member 1100 having a brush assembly 1200 disposed on a first side 1115 and a housing 1300 extending from a second side of the splash guard member 1100. The brush assembly 1200 is configured to move along a vertical axis and rotate about the vertical axis to allow automated and hands-free cleaning of a toilet bowl. A shaft extends from the housing 1300 and through the splash guard member 1100, wherein a distal end of the shaft is secured to the brush assembly 1200 to allow the shaft to mechanically move the brush assembly 1200.

In the illustrated embodiment, the splash guard member 1100 is a circular plate 1130 sized to rest atop a perimeter of the toilet bowl so as to entirely cover an opening of the toilet bowl. The splash guard member 1100 serves to not only prevent liquid from leaving the toilet, but also supports the brush assembly 1200 is an upright configuration to allow hands-free cleaning of the toilet bowl. The plate 1130 is composed of any suitable material, such as plastic. In some embodiments, the plate 1130 is composed of a water-resistant material to prevent warping or other types of damage caused by moisture. In the illustrated embodiment, the plate comprises a circular shape, wherein the upper and lower surfaces are planar. In other embodiments, the splash guard member comprises any suitable shape configured to prevent liquid from leaving the toilet bowl, such as an elliptical or oval shaped cross section. In the illustrated embodiment, the plate 1130 comprises a width between 5 inches to 20 inches and a length between 5 inches to 20 inches to fit over many conventional sized toilets. However, in other embodiments, the plate comprises any suitable width and length to fit on to other sized toilets.

In the illustrated embodiment, the powered toilet bowl brush 1000 comprises a fastener adapted to secure the splash guard member 1100 to the toilet bowl. In the shown embodiment, the fastener is a pair of clamps or hook members 1400 configured to secure the splash guard member 1100 to the toilet bowl by engaging a rim of the toilet bowl. The hook members 1400 face outward in the illustrated embodiment to engage with the interior rim of the toilet bowl. In alternate embodiments, the hook members face inward to engage with an exterior rim of the toilet bowl. The hook members 1400 comprise an elastic or flexible material adapted to compress as the splash guard member is being positioned on the perimeter of the toilet bowl and expand as the hook members 1400 pass into the rim. The hook members 1400 can be easily removed or detached from the rim by opening the hook member 1400 in the opposite direction of the rim and lifting the splash guard member 1400 away from the toilet bowl. In some embodiments, the powered toilet bowl brush does not include a fastener. In other embodiments, the fastener comprises any suitable structure configured to secure the splash guard member to the toilet bowl, such as a strap.

Figure 3:
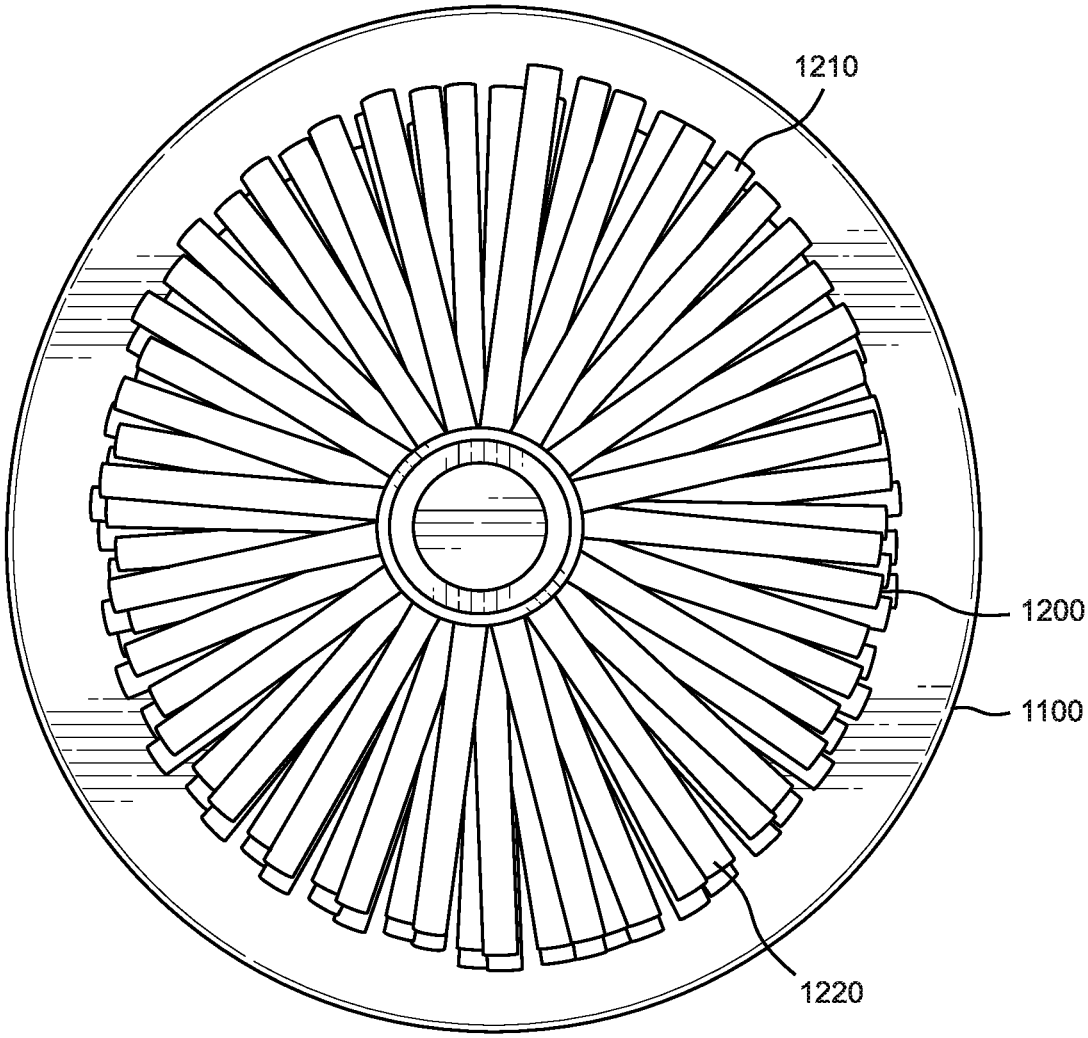
FIG. 3 shows a bottom plan view of an embodiment of the powered toilet bowl brush.

Referring now to FIGS. 2 and 3, there is shown the bottom perspective view and a bottom plan view of an embodiment of the powered toilet bowl brush, respectively. In the illustrated embodiment, the brush assembly 1200 comprises a plurality of layers 1210 of scrubbers 1220. Each scrubber 1220 is adapted clean the surface of the toilet bowl. In the illustrated embodiment, each scrubber 1220 is composed of a flexible cloth-like material, such as microfiber, to allow the scrubbers 1220 to access all areas of the toilet bowl when in use. Within each layer 1210, the scrubbers extend radial from a central point such that all scrubbers within the layer are disposed on a single plane when fully extended. In other embodiments, the scrubbers are composed of a rigid material, such as a bristle, to prevent the scrubber from changing shape from a resting configuration to an in-motion configuration. In other embodiments, a wire or similar deformable material is disposed within a center of each scrubber and then wrapped in a cloth-like material. In some embodiments, each scrubber comprises a flexible memory wire configured to maintain its configuration, but still able to deform when force is applied.

In the illustrated embodiment, a first layer and a second layer of scrubbers 1220 extends in a horizontal plane when in use. In some embodiments, the brush assembly comprises only a single layer of scrubbers. In other embodiments, the brush assembly comprises more than two layers of scrubbers. In some embodiments, each layer of scrubbers 1220 comprises a same diameter when fully extended. In other embodiments, each layer 1210 comprises a different diameter when fully extended. In the illustrated embodiment, each layer of scrubbers 1220 are separated approximately one half of an inch so that while as the brush assembly 1200 is rotated within and cleaning the toilet bowl, the scrubbers 1220 are simultaneously being cleaned. In some embodiments, a length and width of the layer of scrubbers is slightly smaller than the length and width of the splash guard member 1100 (as seen in FIG. 3). This allows for the brush assembly to clean the widest parts of the toilet bowl. Slightly smaller herein, means a distance between 0.5 inches to 3 inches.

In the illustrated embodiment, the brush assembly 1200 is removably secured to the shaft to allow the brush assembly 1200 to be cleaned separate from the housing 1300 and the splash guard member 1100. The brush assembly 1200 is removably secured to the shaft in any suitable manner, such as a locking push pin securement illustrated in FIG. 5.

Figure 4:
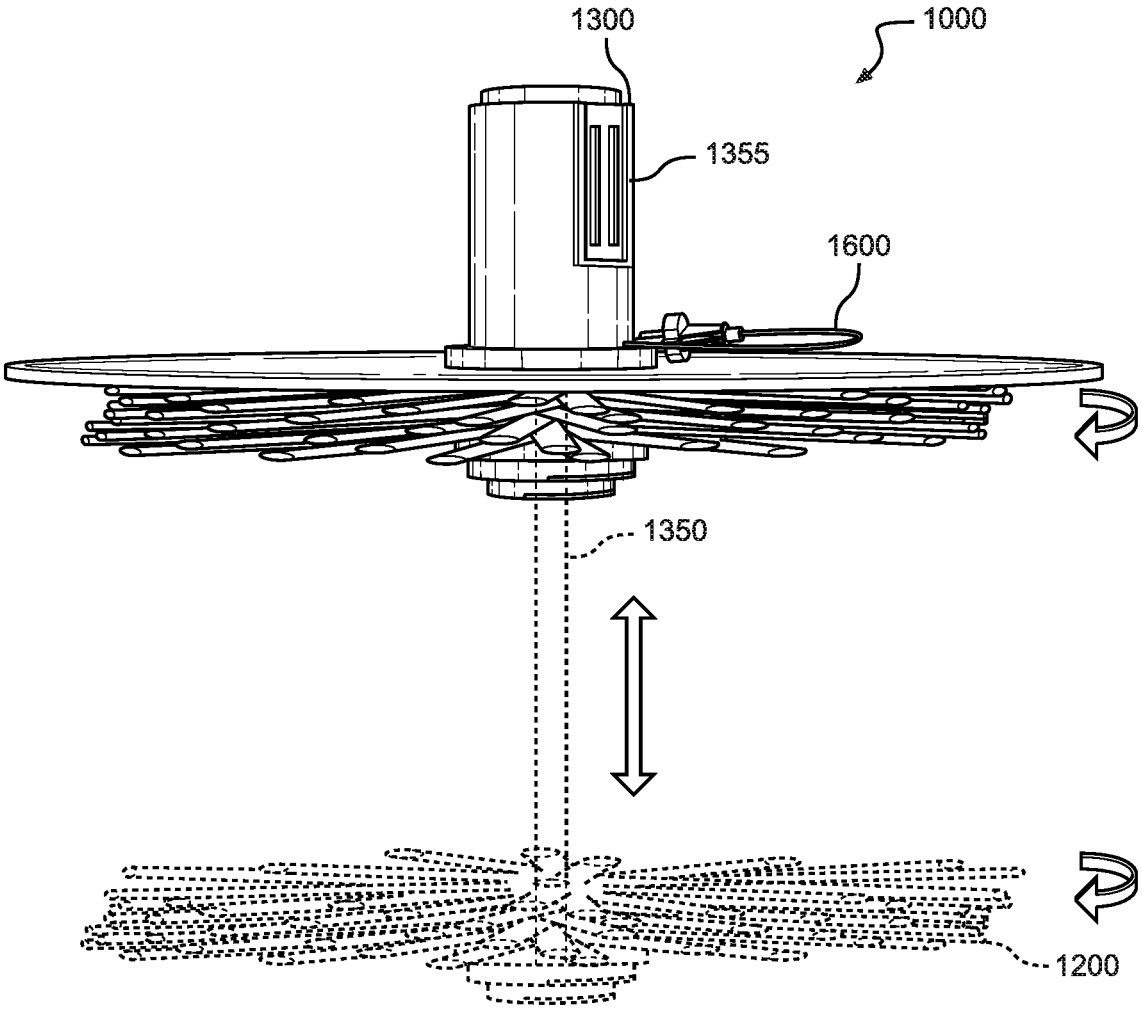
FIG. 4 shows a side view of an embodiment of the powered toilet bowl brush in an extended position and the retracted position.
Figure 5:
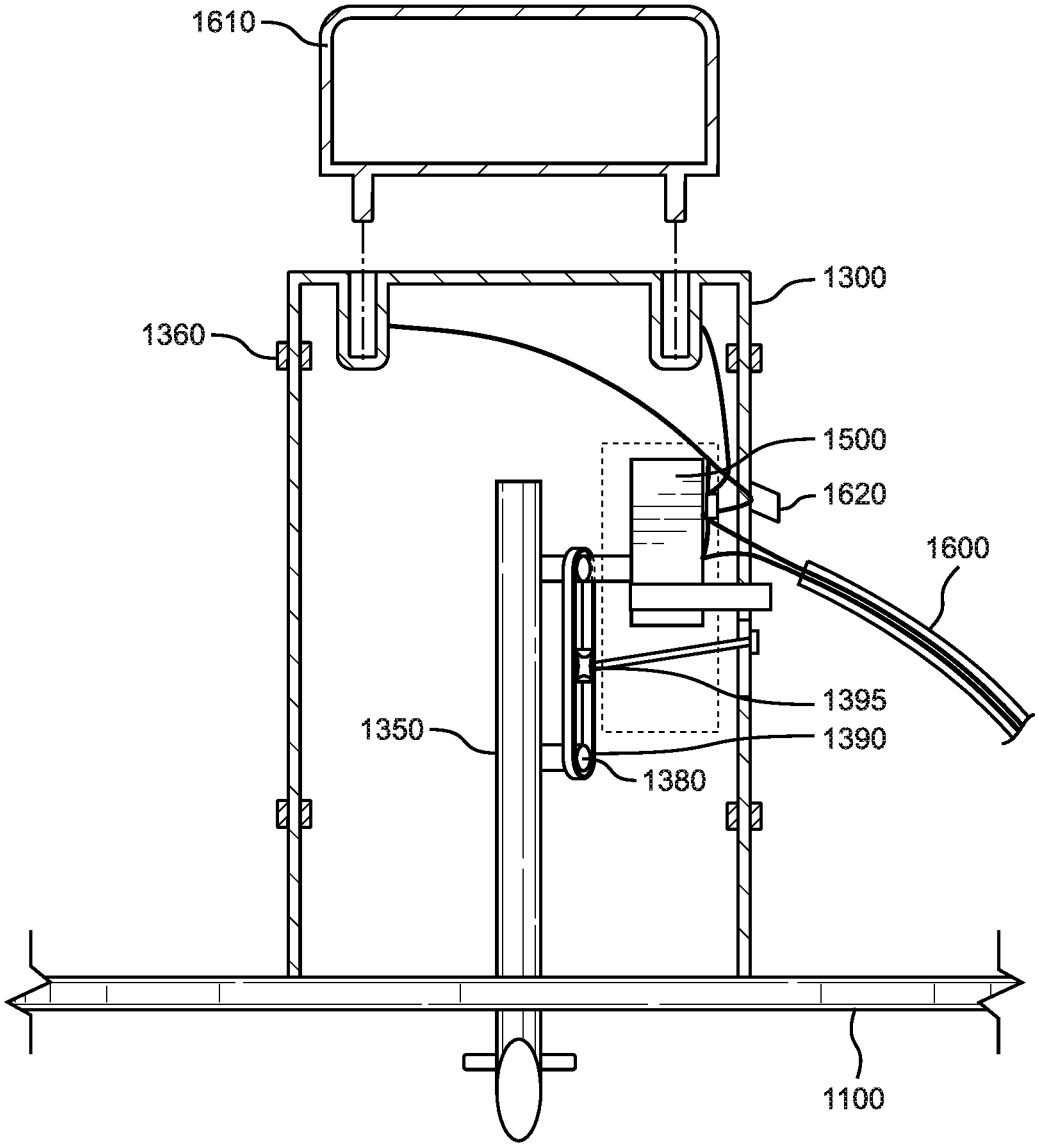
FIG. 5 shows a transparent view of an embodiment of the powered toilet bowl brush.

Referring now to FIGS. 4 and 5, there is shown a side view of an embodiment of the powered toilet bowl brush in an extended position and the retracted position and a transparent view of an embodiment of the powered toilet bowl brush, respectively. In the illustrated embodiment, the housing 1300 of the powered toilet bowl brush 1000 comprises a cylindrical shape having a hollow interior volume. In alternate embodiments, the housing comprises any suitable shape. The housing 1300 houses the shaft 1350 and other mechanical components separate from the brush assembly 1200 to prevent exposure to moisture. In the illustrated embodiment, the shaft 1350 is galvanized to prevent rust buildup thereon. In the illustrated embodiment, the housing comprises a door 1355 (the door is removed in FIG. 5 as can be seen by the door fasteners 1360 shown) along a vertical sidewall that allows access to the interior volume thereof.

In the illustrated embodiment, the shaft 1350 is operably connected to and moved via a motor 1500 disposed within the housing 1300. The motor 1500 is operably connected to the shaft 1350 via a gear 1380 and belt 1390 system, wherein the gear and belt system cooperatively operated to move the shaft 1350 up and down. In one embodiment, the gear and belt system comprise an arm mounted to the gear 1380 that is radially offset, wherein the arm is pivoted to the shaft. In this way, the rotation of the gear allows for vertical motion of the shaft. In one embodiment, the shaft 1350 includes a gear mounted perpendicular and meshed with the gear 1380, such that rotation of the gear 1380 causes rotation of the shaft 1350. Some embodiments comprise an idle tensioner to maintain tension in the belt, as well as an idle tensioner slide 1395 to allow the tension of the belt to be adjusted.

The shaft 1350 is configured to move up and down along the vertical axis to allow the brush assembly to move between a raised position to a lowered position. In the raised position, the brush assembly 1200 is closest to the splash guard member 1100 and configured to allow cleaning of the upper end of the toilet bowl. In the lowered position, the brush assembly 1200 is further away from the splash guard member 1100 and capable of contacting the bottom most area of the toilet bowl. In some embodiments, the brush assembly 1200 is pivotally connected to the shaft 1350 to allow the brush assembly to tilt from side to side as the brush assembly is moved over changing surface levels of the toilet bowl.

In the illustrated embodiment, the brush assembly 1200 is configured to rotate 360 degrees about the vertical axis of the shaft 1350. In some embodiments, the brush assembly 1200 is rotatably connected to the shaft 1350 to permit rotation thereof while the shaft 1350 is moving along the vertical axis.

The powered toilet bowl brush comprises a power source to power the motor when in use. In the illustrated embodiment, a first power source is electrical plug 1600 extending from the housing 1300 that is configured to plug into an electrical outlet. The illustrated embodiment further comprises a second power source, which is a battery 1610 removably secured to an upper end of housing 1300 and operably connectable to the motor. The second power source can be used if an outlet is not readily accessible adjacent to the toilet to be cleaned. A switch 1620 or other type of actuator is positioned on an exterior of the housing and operably connected to the motor 1500

Figure 6:
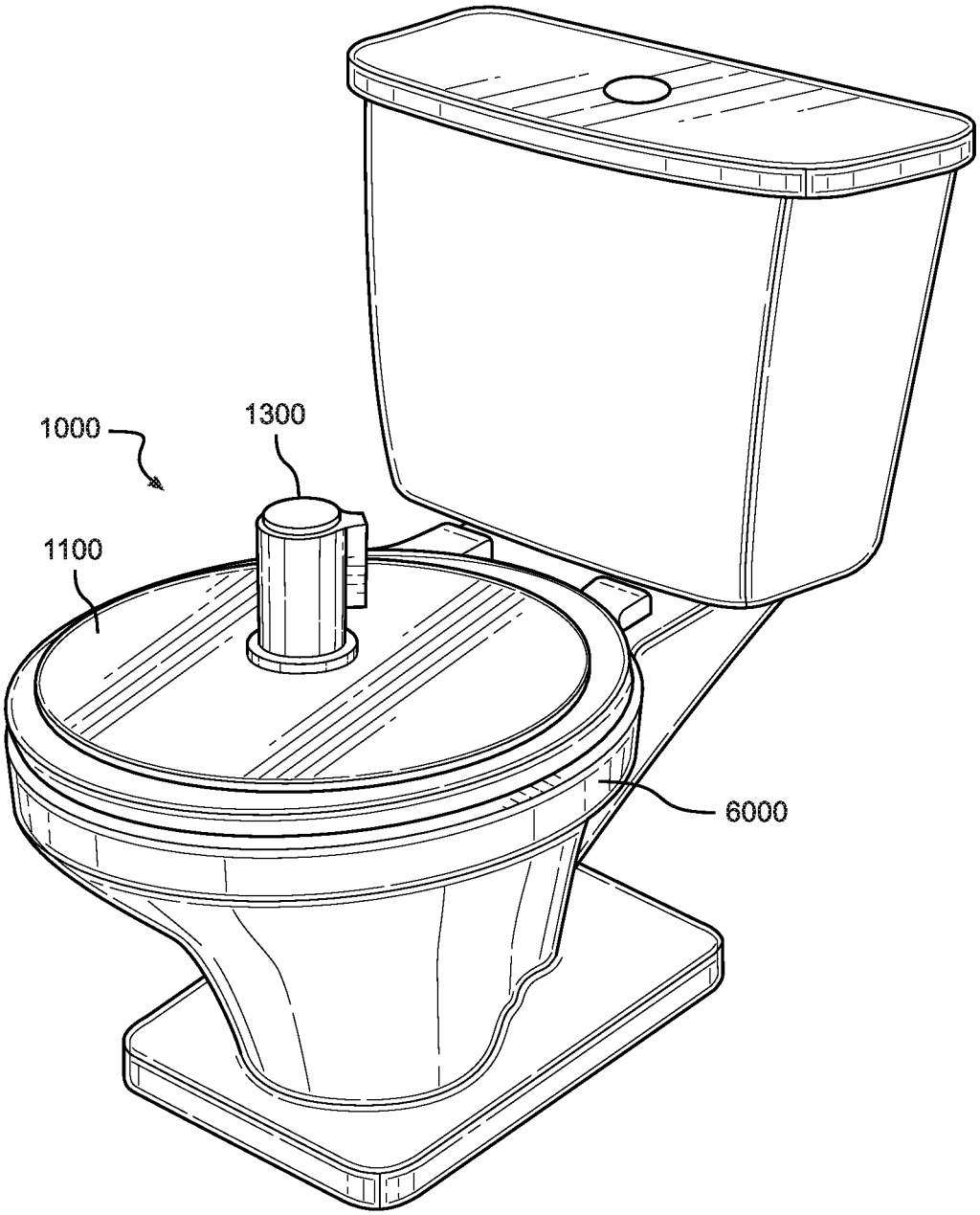
FIG. 6 shows a perspective view of an embodiment of the powered toilet bowl brush in use.

Referring now to FIG. 6, there is shown a perspective view of an embodiment of the powered toilet bowl brush in use. In operation, the splash guard member 1100 is placed on top of the perimeter of the toilet bowl 6000, such that no gap is visible between the splash guard member 1100 and the perimeter of the toilet bowl 6000. In the shown embodiment, the toilet bowl lacks a seat that is hingedly mounted to the toilet bowl. However, in the shown embodiment, the splash guard is dimensioned to fit to the toilet bowl without requiring removal of the seat from the toilet bowl. In some embodiments, the fastener extending from the splash guard member 1100 will be secured to the rim of the toilet bowl to secure the powered toilet bowl brush 1000 tightly on to the toilet bowl 6000 to prevent movement while the brush assembly is in motion. Upon actuation of the switch, the motor is turned on and powers both the vertical movement of the shaft and the rotation of the brush assembly. Once the toilet bowl is cleaned, the motor is turned off via the switch and the splash guard member 1100 is removed therefrom. The brush assembly is then detached from the splash guard member 1100 for further cleaning if needed or to be dried separately from the housing 1300. The powered toilet bowl brush is light weight and potable to allow a user to easily transport the device without assistance.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A powered toilet bowl brush, comprising:

a splash guard member comprising a planar plate having an exterior face and an opposing, parallel interior face, wherein the interior face is configured to rest directly atop a perimeter of a toilet bowl when in a working position, thereby preventing a gap between the splash guard member and the perimeter of the toilet bowl;

wherein the splash guard member entirely covers an opening of the toilet bowl in the working position;

a brush assembly disposed on a first side of the splash guard member;

a housing extending from a second side of the splash guard member, wherein the housing comprises a door along a vertical sidewall that allows access to an interior volume thereof;

a shaft extending from the housing and through the splash guard member, wherein a distal end of the shaft is secured to the brush assembly;

a motor is disposed within the housing and operably connected to the shaft to move the shaft between an extended configuration and a retracted configuration;

wherein the shaft is configured to move the brush assembly between the extended configuration and the retracted configuration along a vertical axis via the motor, the vertical axis being coaxial with the shaft;

wherein, in the retracted configuration and extended configuration, a scrubber of the brush assembly is adapted to engage a lateral side of the toilet bowl;

wherein the scrubber is composed of a flexible fiber adapted to hang downward under gravitational force when the brush assembly is not in motion and upon activation of the brush assembly, the scrubber extends outward along a horizontal axis due to centrifugal force.

2. The powered toilet bowl brush of claim 1, wherein the brush assembly is configured to mechanically rotate around the vertical axis.

3. The powered toilet bowl brush of claim 1, wherein the brush assembly comprises a plurality of scrubbers arranged in a first layer of scrubbers extending in a horizontal plane when secured to the shaft.

4. The powered toilet bowl brush of claim 3, wherein the plurality of scrubbers form a second layer vertically offset from the first layer, such that the first and second layers are disposed on different horizontal planes at a mounting point with the shaft, the second layer extending in a horizontal plane when secured to the shaft and parallel to the first layer.

5. The powered toilet bowl brush of claim 4, wherein the first layer and the second layer of scrubbers each comprise a different diameter.

6. The powered toilet bowl brush of claim 3, wherein each scrubber of the first layer of scrubbers is composed of microfiber.

7. The powered toilet bowl brush of claim 1, wherein the shaft is composed of a galvanized material.

8. The powered toilet bowl brush of claim 1, further comprising a battery removably secured to the housing and adapted to supply power to the motor.

9. The powered toilet bowl brush of claim 1, further comprising a plug extending from the housing and configured to power the motor.

10. The powered toilet bowl brush of claim 1, further comprising a fastener configured to secure the splash guard member to the toilet bowl.

11. The powered toilet bowl brush of claim 10, wherein the fastener is a flexible clamp configured to removably secure to an interior rim of the toilet bowl.

12. The powered toilet bowl brush of claim 11, wherein the fastener comprises a pair of fasteners disposed on the first side of the splash guard member, opposite each other.

13. The powered toilet bowl brush of claim 1, wherein the brush assembly is removably secured to the shaft.

14. The powered toilet bowl brush of claim 1, wherein the brush assembly is pivotally secured to the distal end of the shaft.

15. The powered toilet bowl brush of claim 1, wherein the motor is operably connected to the shaft via a gear and belt, wherein the gear and belt cooperatively operate to move the shaft along the vertical axis.

16. The powered toilet bowl brush of claim 15, further comprising an idle tensioner to maintain a tension in the belt and an idle tensioner slide to allow the tension of the belt to be adjusted.

17. The powered toilet bowl brush of claim 8, wherein the battery is removably secured to an upper end of housing and operably connectable to the motor.

* * * * *